United States Patent [19]

Mode

[11] Patent Number: 4,871,111

[45] Date of Patent: Oct. 3, 1989

[54] TAPERED TRAY WITH PRE-GLUED ELEVATING LEGS

[75] Inventor: Duane R. Mode, Bloomington, Minn.

[73] Assignee: Waldorf Corporation, St. Paul, Minn.

[21] Appl. No.: 183,971

[22] Filed: Apr. 20, 1988

[51] Int. Cl.[4] ..... B65D 5/26

[52] U.S. Cl. ..... 229/104; 229/3.5 MF; 229/112; 229/171; 229/182; 229/903

[58] Field of Search ..... 426/107, 113, 234, 243; 219/10.55 E; 229/104, 112, 171, 182, 3.5 MF, 903

[56] References Cited

U.S. PATENT DOCUMENTS

| | | | |
|---|---|---|---|
| 711,813 | 10/1902 | Austin et al. | 229/104 |
| 743,205 | 11/1903 | Tupper et al. | 229/104 |
| 930,882 | 8/1909 | Perkins | 229/104 |
| 2,292,540 | 8/1942 | Norton | 229/104 |
| 2,620,117 | 12/1952 | Nemoede | 229/104 |
| 3,078,171 | 2/1963 | Skowronski | 229/104 |
| 3,944,129 | 3/1976 | McCall | 229/104 |
| 4,096,948 | 6/1978 | Kuchenbecker | 426/113 |
| 4,228,945 | 10/1980 | Wysocki | 426/113 |
| 4,253,602 | 3/1981 | Kulig | 229/903 |
| 4,279,374 | 7/1981 | Webinger | 426/113 |
| 4,505,391 | 3/1985 | Kuchenbecker | 426/113 |
| 4,538,732 | 9/1985 | Kuchenbecker | 229/104 |
| 4,584,202 | 4/1986 | Roccaforte | 426/107 |
| 4,592,914 | 6/1986 | Kuchenbecker | 426/107 |
| 4,594,492 | 6/1986 | Maroszek | 426/113 |
| 4,626,641 | 12/1986 | Brown | 426/107 |
| 4,642,434 | 2/1987 | Cox et al. | 426/107 |
| 4,703,148 | 10/1987 | Mikulski et al. | 219/10.55 E |
| 4,713,510 | 12/1987 | Quick et al. | 426/107 |

FOREIGN PATENT DOCUMENTS

| | | | |
|---|---|---|---|
| 192012 | 10/1964 | Sweden | 229/171 |

OTHER PUBLICATIONS

"Microwave Heating", by David A. Copson, p. 289, 1962.

*Primary Examiner*—Gary Elkins
*Attorney, Agent, or Firm*—Dorsey & Whitney

[57] ABSTRACT

A package for holding food for cooking in a microwave oven has a flat central panel for supporting the food, which has at least three linear panel edges. A flat side wall is attached at a fold line to at least two of the panel edges of the central panel. Each side wall has an inner panel and an outer panel affixed against the inner panel. The outer panel has a maximum width as measured perpendicular to the fold line connecting the side wall to the central panel that is greater than the width of the inner panel, also measured perpendicular to the fold line. The invention also encompasses a flat blank that can be folded and locked or glued into the preceding package configuration. For microwave oven use, the blank is made from paperboard material having a layer of microwave interactive material that heats to browning temperatures when exposed to microwaves.

16 Claims, 1 Drawing Sheet

TAPERED TRAY WITH PRE-GLUED ELEVATING LEGS

TECHNICAL FIELD

The present invention relates to food packaging, including packaging suitable for use in a microwave oven. More particularly, the present invention relates to a package in which foods such as french bread pizza or other foods for which surface browning is desired may be packaged, shipped and cooked.

BACKGROUND ART

In recent years, microwave ovens have become increasingly popular. This has created an increasing demand for economical, simple, disposable containers which, when used in a microwave oven, produce cooking results, including surface browning and crisping, comparable to those to which people are accustomed with cooking in conventional ovens. For consumer convenience, it is desirable to have the package be so constructed that the food item, together with all or a portion of the package in which it is contained, can be placed directly in the oven.

Paperboard cartons have been found to be an economical way to meet many microwave packaging requirements. In particular, a number of cartons for browning microwave foods have been successfully introduced that are made from paperboard to which a metallized plastic film has been laminated, with the thin metal layer being sandwiched between the plastic film and the paperboard. A suitable adhesive is used to hold the laminated layers together. One laminated material of this kind is shown in U.S. Pat. No. 4,641,005.

Although microwave browning packages of several kinds are now widely sold and the surface browning capability of a metallized film-paperboard laminate used in such packages is widely accepted, the effect of unusual food and package shapes, of multiple layers of microwave absorbing materials and other specialized package configurations on cooking results is not well understood. This is apparently attributable to the complex combination of reflections, refractions and absorptions of microwave radiation occuring in the oven, the food and the packaging. It is also attributable to the different way in which microwaves cook food, as compared to the heating modes of conventional ovens. Accordingly, development of specific package configurations has proceeded slowly and empirically as the microwave cooking possiblities of various food items are explored.

One microwave cooking phenomenon that has been noted is that most foods tend to cook better when they are raised above the floor of the microwave oven. Several prior patents have been directed to packages that elevate food for microwave cooking, e.g., U.S. Pat. Nos. 4,642,434; 4,698,472. However, these packages have had certain disadvantages. For example, a package made from light paperboard, with single-ply walls, may not be able to support heavy food items. In addition, prior packages have been complex and require the development of new or modified packaging machinery. Accordingly, there is a need for simple, effective paperboard package for elevating food for microwave cooking or other forms of cooking where food elevation may be desirable.

SUMMARY OF THE INVENTION

In accordance with the present invention, a package for holding food for cooking in a microwave oven comprises a substantially flat central panel for supporting the food, which has at least three substantially linear panel edges. A substantially flat side wall is attached at a fold line to at least two of the edges of the central panel. Each side wall comprises an inner panel and an outer panel affixed against the inner panel. The outer panel has a maximum width as measured perpendicular to the fold line connecting the side wall to the central panel that is greater than the width of the inner panel, also measured perpendicular to the fold line. The invention also encompasses a flat blank that can be folded and locked or glued into the preceding package configuration. For microwave oven use, the blank is made from paperboard material having a layer of metallized plastic film laminated to the paperboard so that the thin metal layer is sandwiched between the plastic and the paperboard.

A primary objective of the present invention is to provide a microwave cooking package for holding and elevating a food item that needs browning on its lower surface.

Another objective of the invention is to provide a food-holding tray that has double-ply side walls, permitting it to support heavier food items.

A further objective of the present invention is to provide a simple, paperboard blank from which a tray for microwave or conventional cooking can be easily formed.

These and other objectives of the present invention will become apparent with reference to the drawings, the description of the preferred embodiment and the appended claims.

DESCRIPTION OF THE PREFERRED EMBODIMENT

Figure 1:
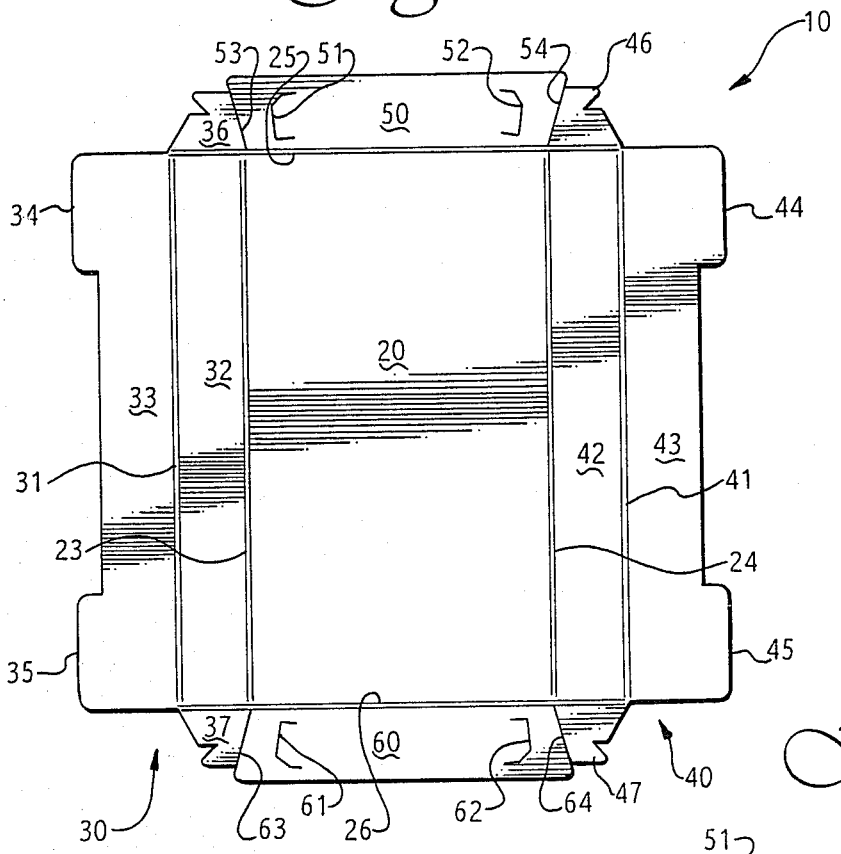
FIG. 1 is a top plan view of the paperboard blank of the invention showing the profile, cuts and bending scores.

As best seen in FIG. 1, a blank 10 in accordance with the present invention has a rectangular central panel 20 with four fold lines 23, 24, 25, 26 defining its two opposed pairs of edges. (In the drawings double lines indicate scores used to form fold lines. Single solid lines indicate cuts or free edges.) Attached to the opposing parallel edges 23, 24 are side walls 30, 40. The left side wall (as seen in FIG. 1) includes an inner panel 32 and an outer panel 33 joined to the inner panel 32 at a fold line 31. Fold line 31 is substantially parallel to fold line 23. At the opposing ends of inner panel 32, at fold lines that are extensions of the fold lines 25, 26 (defining the upper and lower edges of central panel 20) is a pair of locking tabs 36, 37. Each locking tab 36, 37 is cut to have a hook-shaped configuration. Inner panel 32 and outer panel 33 are both rectangular and of roughly the same size and shape, except that outer panel 33 has a pair of projections, extension flaps 34, 35, extending from its outer edge (opposite fold line 31). Because of these projections, the maximum width of the outer flap 33 is greater than that of the inner flap 32 (both measurements being taken in a direction perpendicular to the fold lines 23, 31).

The right side wall 40 (as seen in FIG. 1) is a mirror image of the left side wall 30. That is, it includes inner and outer panels 42, 43, respectively, joined at a fold line 41. The inner panel 42 is joined to the central panel 20 at fold line 24 and has the same type of locking tabs 46, 47 at its ends as are found on inner panel 32. Outer panel 43 has the same size relationship to inner panel 42 as outer panel 33 does to inner panel 32. In addition, outer panel 43 has projecting extension flaps 44, 45 that correspond to extension flaps 34, 35 of the left side outer panel 33.

Connected at opposed, parallel top and bottom fold lines 25, 26 of the central panel 20 are end walls 50, 60. Each of these is generally trapezoidal in shape, due to a slight inward tapering of the edges 53, 54 and 63, 64 that are roughly perpendicular to the fold lines 25, 26. Near each end of the end wall 50 is a roughly C-shaped slit 51, 52. End wall 60 is a mirror image of end wall 50. It likewise has C-shaped slits 61, 62 near its inward-tapering edges 63, 64.

Figure 2:
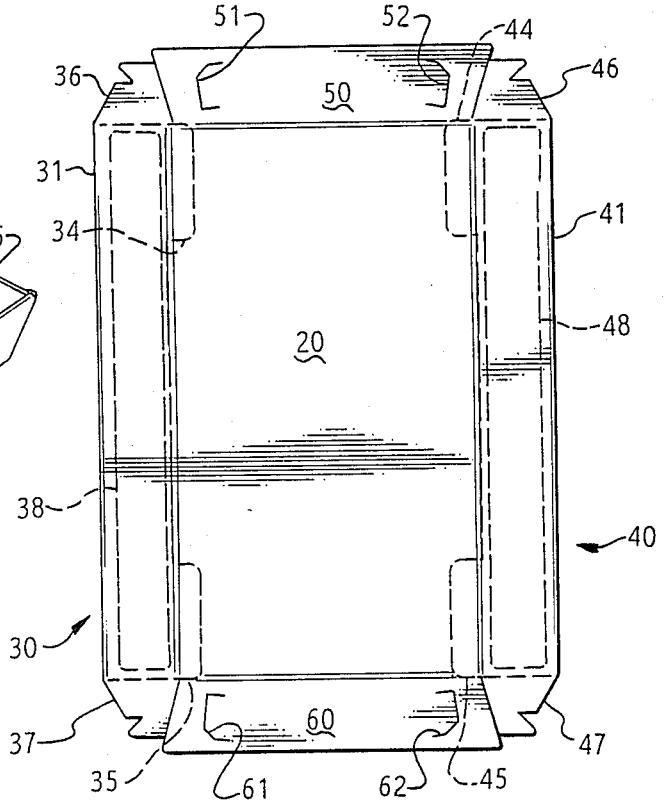
FIG. 2 is a view similar to that of FIG. 1 with preliminary gluing and folding operations to form the side walls having been completed.

Turning next to FIG. 2, a partially assembled form of the blank 10 is shown. As shown in FIG. 2, the blank 10 has the left and right outer panels 33, 43 folded under along fold lines 31, 41, respectively. Glue areas 38, 48 are used to affix the outer panel 33 to the inner panel 32 and the outer panel 43 to the inner panel 42. Double-ply side walls 30, 40 result from this gluing. It should be noted that the extension flaps 34, 35 and 44, 45 are not glued to the underside of the central panel 20, which they lie adjacent to in FIG. 2.

Figure 3:
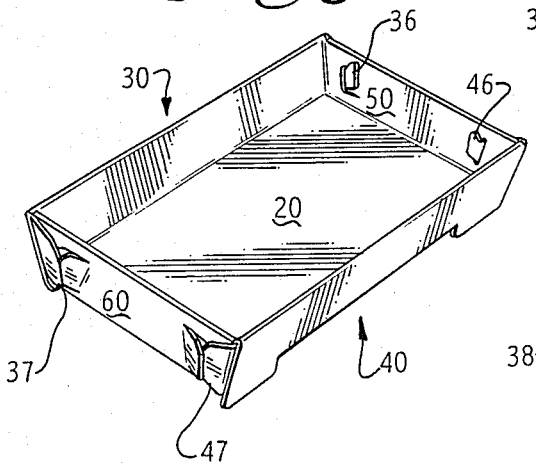
FIG. 3 is a pictorial view the assembled package of the present invention.

The manufacturer of the blank 10 would normally fold and glue it into its partially assembled (but still flat) form as shown in FIG. 2 before sending it to the food packager. The food packager has two options. If the food item involved requires containment or is viewed as more attractive when presented in an erected tray, the food packager can fully assemble the tray as shown in FIG. 3. This assembly is easily done on conventional machinery such as: the Kliklok J.R. made by Kliklok Corporation (Greenwich, Conn.); the Bradlok 2/60 by Bradman-Lake Ltd. (Bristol, U.K.); the AF 60 Lock former made by Adco (Sanger, Calif.); and the MP made by Sprinter System AB (Halmstad, Sweden). First, the machinery raises the side walls 30, 40 and the end walls 50, 60 by folding them at approximately ninety degrees at fold lines 23, 24, 25, 26 so that the various locking tabs 36, 37, 46, 47 can reach the corresponding adjacent slit. Locking involves the insertion of the hook end of flap 36 into slit 51, the insertion of hook end of flap 37 into the slit 61, the insertion of the hook end of flap 46 in slit 52 and the insertion of the hook end of flap 47 into the slit 62. As shown in FIG. 3, this may be done by placing locking tabs 36, 37, 46, 47 outside of the end walls 50, 60. It might also be done by placing the locking tabs 36, 37, 46, 47 inside the end walls 50, 60 (not shown). (It will be equally clear that the locking tabs could be plain flaps connected to end walls 50, 60 by cold glue adhesives, heat sealing or other means.) Once the tray is assembled, a food item can be placed in it. This can then be overwrapped with a plastic film or placed in a box (not shown), as desired or required for the particular food item involved.

As an alternative to assembling the blank 10 into a completed tray as shown in FIG. 3, the food packager can simply include the partially assembled tray of FIG. 2 as a flat item in a larger package. The consumer can then be given instructions on how to erect the tray and place the food item on it for microwave cooking.

Figure 4:
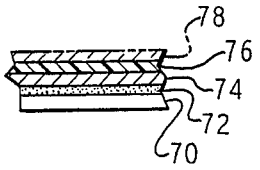
FIG. 4 is a greatly enlarged cross-sectional fragment of a laminated paperboard material that can be used in the invention, with one layer shown in phantom line.

While conventional oven cooking might make it necessary or desirable to utilize an elevated tray, the invention is probably best suited for microwave cooking. For many food items it has been found that elevation above the floor of the microwave oven improves cooking. In addition, the tray of the present invention offers the opportunity to brown food surfaces in contact with the tray. FIG. 4 shows a fragmentary cross section of a laminated material for use in the present invention. The substrate is paperboard 70. A plastic film 76 (such as polyester film) with a layer of metallization 74 (such as vapor-deposited aluminum) is laminated to the paperboard 70 using a suitable adhesive 72. If desired, a release coat 78 may be applied on top of the plastic film 76. In food browning applications, the food surface to be browned is placed in contact with the surface of the plastic film 76 (with or without a relase coat 78). Accordingly, the blank 10 of the present invention is constructed with the plastic film 76 on the surface of the blank 10 that becomes the inside surface of tray as shown in FIG. 3.

Other materials exist for producing a browning or surface heating effect and would be equally adaptible to the present invention. All that is necessary is that a substantial portion of the surface area of the central panel 20 or other surface (e.g., sides 32, 42 or ends 50, 60) where a browning effect is desired include microwave interactive materials that heat to browning or heat transfer temperatures when exposed to microwaves. To avoid arcing that may occur between the package and the floor of the microwave oven, the microwave interactive material should be absent from the lower portion of each outer panel 33, 43 or might be limited so as not to extend beyond fold lines 31, 41 at all. If no side surface heating were desired, microwave interactive materials could be limited to the area enclosed by fold lines 23, 24, 25, 26. Where a metallized film-paperboard laminate is used to make the package, selective metallization can be used to obtain selective placement of microwave interactive materials only in those areas where surface heating is desired. (This technique and products resulting therefrom are described in U.S. patent application Ser. No. 008,004, filed Jan. 29, 1987, assigned to the assignee of the present application.)

The desired degree of elevation for the tray determines the amount by which the maximum width of outer panels 33, 43 exceeds the width of inner panels 32, 42. The objective is to utilize the microwave intensity peaks resulting from interference patterns in the microwaves reflected from the floor of the microwave oven. While oven conditions (such as the thickness of a false floor) may vary, it has been found that raising a food item above the reflecting floor of the microwave oven (which may be covered by a false floor) a distance equal to about one-fourth of the wavelength of the primary microwave wavelengths used in commercial microwave ovens (915 MHz-32 cm; 2450 MHz-12 cm) improves cooking. In the preferred embodiment of the invention, the width of extension flaps 34, 35, 44, 45 is selected to achieve the desired elevation.

A number of variations on the present invention can be made. For example, the included angle of the sidewalls 30, 40 and end walls 50, 60 relative to the central panel 20 can be 90 degrees or greater than 90 degrees. As shown in FIG. 3, the angle is slightly greater than 90 degrees, yielding tapered sides that help trays to nest when stacked. Also, while a tray based on a rectangular center panel has been described, it will be clear that the invention is equally useful, with small adaptions, to a triangular tray (in which two or more sides of the triangular center panel would have side walls attached) or to a pentagon, hexagon or higher-order polygon, with a greater number of side walls.

Although the description of a preferred embodiment has been presented, it is contemplated that various changes could be made without deviating from the spirit of the present invention. Accordingly, it is intended that the scope of the present invention be dictated by the appended claims rather than by the description of the preferred embodiment.

What is claimed and desired to be protected by Letters Patent is:

1. A collapsible package for holding food comprising:

a substantially flat central panel for supporting said food, said panel having first and second pairs of opposed, substantially linear panel edges and four corners; and first and second substantially flat side walls, each of said side walls being attached to one of said first pair of opposed central panel edges at an inner fold line substantially coinciding with said central panel edge, each said side wall being disposed at approximately 90 degrees relative to said central panel, and comprising:

an inner panel extending above the plane of said central panel;

an outer panel joined to said inner panel at an outer fold line substantially parallel to said inner fold line and adhered against said inner panel to form a double layer above the plane of said central panel, said outer panel having a maximum width, as measured perpendicular to said inner fold line, that is greater than the width of said inner panel measured perpendicular to said inner fold line, said outer panel extending in a single layer below the plane of said central panel to the extent of said greater width;

a pair of opposed end walls, each attached to said central panel at one end fold line located at one of the second pair of opposed edges of said central panel; and hook and slit locking means adjacent each corner of the central panel for locking together adjacent side walls and end walls to maintain said side walls disposed at approximately 90 degrees relative to said central panel.

2. The package as recited in claim 1 wherein the package is for cooking food in a microwave oven and at least a substantial portion of the surface area of said central panel comprises a microwave interactive material that heats up to a temperature sufficient to heat the surface of food in heat transfer relationship with said central panel when said central panel is exposed to microwaves.

3. The package as recited in claim 2 wherein at least a substantial portion of the surface of the inner panel of each side wall comprises a microwave interactive material that heats up to a temperature sufficient to heat the surface of food in heat transfer relationship with each said inner panel when each said inner panel is exposed to microwaves.

4. The package as recited in claim 1 wherein the package is for cooking food in a microwave oven and is made from paperboard to which a thinly metallized plastic film is laminated with the metal layer being sandwiched between the paperboard and plastic film.

5. The package as recited in claim 4 wherein the maximum width of said outer panel exceeds the width of said inner panel by about one-fourth of the primary wavelength utilized in said microwave oven.

6. The package as recited in claim 4 wherein the plastic film is selectively metallized so that the metal layer does not extend to substantial portions of said outer panel.

7. The package as recited in claim 1 wherein each side wall is disposed so that the included angle between the side wall and the central panel is slightly greater than 90 degrees.

8. The package as recited in claim 1 wherein said central panel is rectangular in shape.

9. The package as recited in claim 8 wherein said opposed end walls are attached to said central panel at end fold lines perpendicular to said inner fold lines, said end walls being disposed at approximately 90 degrees relative to said central panel.

10. A flat blank for forming an elevated tray for holding food comprising:

a substantially rectangular central panel for supporting said food having a first pair of opposed, parallel linear panel edges;

first and second side walls, each of said side walls being attached to one of said first pair of opposed, parallel central panel edges, each said side wall comprising:

an inner panel adapted to extend above said central panel and having an inner edge joined to the central panel at an inner fold line;

an outer panel joined to said inner panel at an outer fold line substantially parallel to said inner fold line and adapted to extend downward from said outer fold line and below said central panel, each said outer panel having a maximum width as measured perpendicular to said outer fold line that is greater than the width of said inner panel measured between said inner and outer fold lines wherein each inner panel of each side wall has a pair of opposed locking tabs attached to opposed edges at locking tab fold lines that are perpendicular to said inner fold lines and each end flap has a pair of slits therein designated to receive a portion of the adjacent locking tab when the end flaps and side walls are raised to form sides of said tray.

11. The flat blank as recited in claim 10 wherein the flat blank is adapted to form a package for cooking food in a microwave oven and is made from paperboard to which a thinly metallized plastic film is laminated with the metal layer being sandwiched between the paperboard and plastic film.

12. The flat blank as recited in claim 11 wherein the maximum width of said outer panel exceeds the width of said inner panel by about one-fourth of the primary wavelength utilized in said microwave oven.

13. The flat blank as recited in claim 10 wherein said inner and outer panels of said side walls are rectangular and of approximately the same size and shape, except that each said outer panel has at least one projection thereon whose width measured in a direction perpendicular to said outer fold line is approximately one-fourth of the primary wavelength utilized in said microwave oven.

14. The flat blank as recited in claim 10 wherein each outer panel of each side wall is folded 180 degrees at said outer fold line to lie under its adjacent inner panel and is adhered to said inner panel so that each side wall is of double thickness between said inner and outer fold lines and a portion of each outer panel extends under said central panel.

15. The flat blank as recited in claim 14 wherein each outer panel has two projections thereon, one being located at each end of an edge of said outer panel located opposite said outer fold line.

16. The flat blank as recited in claim 10 wherein the tray is for cooking food in a microwave oven and at least a substantial portion of the surface area of said central panel comprises a microwave interactive material that heats up to a temperature sufficient to heat the surface of food in heat transfer relationship with said central panel when said central panel is exposed to microwaves.

* * * * *